United States Patent [19]

Viannay et al.

[11] Patent Number: 4,711,431

[45] Date of Patent: Dec. 8, 1987

[54] SPRAY-COOLING APPARATUS

[75] Inventors: Stéphane G. J. Viannay, Voisin-le-Bretonneux; Bernard M. Roth, Boulogne-Billancourt; Solange M. V. Mirigay, Chaville; Georges J. B. Chastang, Coignieres, all of France

[73] Assignee: Bertin & Cie, Plaisir-Cedex, France

[21] Appl. No.: 836,481

[22] Filed: Mar. 5, 1986

[30] Foreign Application Priority Data

Mar. 6, 1985 [FR] France ..... 85 03281

[51] Int. Cl.[4] ..... C21D 1/667

[52] U.S. Cl. ..... 266/114; 266/259

[58] Field of Search ..... 266/111, 114, 113, 259; 72/201; 134/64 R, 122 R

[56] References Cited

U.S. PATENT DOCUMENTS 2,009,078 7/1935 Ziska ..... 266/113

FOREIGN PATENT DOCUMENTS 31517 6/1981 European Pat. Off. ..... 266/113

*Primary Examiner*—Christopher W. Brody

*Attorney, Agent, or Firm*—A. W. Breiner

[57] ABSTRACT

Apparatus comprising one suction chamber opposite the upper surface of the sheet material and at least at the entry point and at the exit point. The spray bars (7 to 9) are arranged between two adjacent suction chambers (3, 4; 4, 5; 5, 6). The chambers are arranged above the droplet deflection zone which is limited by the flaps mounted on the edges of the chamber opening.

Spray bars are also provided opposite the lower surface of the material.

9 Claims, 3 Drawing Figures

SPRAY-COOLING APPARATUS

The invention relates to a spray-treatment apparatus intended more particularly for cooling metallurgical products and comprising, in succession, spraying means and a suction chamber arranged opposite a continuously moving material such as a plate, metal sheet, etc.

In the case of apparatus intended for coating a surface with a powdery product or material, efforts have been made to prevent the dispersion of the said product or material in the atmosphere, for ecological and/or economic reasons.

Therefore, manual or automatic painting apparatus always have suction means in which the paint spray and the solvents are separated from the spraying air before being discharged into the atmosphere.

Apparatus which have the same aims have been adapted for operations involving the projection of powdery products onto surfaces already provided with a base coating before proceeding to fix the coating by means of heat or chemical treatment.

European Patent Application No. 0,117,958 describes a device intended to collect a gas containing a metal powder after the said gas has been used to coat a strip provided with a base coating. The device comprises a chamber consisting of two symmetrical cases between which the strip to be covered passes. The chamber is divided in the longitudinal direction into three compartments, the first and last compartments comprising means for injecting the powder-containing gas and the central compartment having recovery slots for collecting the gas containing residual metal powder. The central compartment is connected to the suction source of a fan and the laden gas is sent to a metering device which restores the powder content before the said gas returns into the gas-injection means. Aerodynamic seals are provided at the ends of the chamber in order to prevent the injected gas containing metal powder escaping outside the device.

This device is particularly well suited for gases transporting dry powders, but the problems to be resolved are very different if, for example, it is required to collect a sprayed liquid as in the case of a heat treatment apparatus with rows of sprayed-water jets intended to cool a high temperature material passing in front of them. In fact, in the case of film boiling conditions (non-wetting conditions) occurring for example for steel sheets at wall temperatures greater than approximately 400° C. to 500° C., the water droplets split up when they come into contact with the wall to be cooled, with only a very small degree of evaporation, and bounce off it.

If these deposits are not removed, they grow larger and fall back onto the metal sheet, thereby giving rise to the accumulation of water. This water then drains off towards the sides of the metal sheet which undergo more intense cooling than the middle.

In order to prevent this, an air flow must be created which is sufficient to transport the droplets after they have split up.

The object of the invention is to provide an apparatus for treatment by means of liquid spraying, intended to cool a continuously moving metallurgical product and to remove the sprayed water by channelling the gas streams transporting the droplets in such a way as to prevent symmetrical cooling of the treated surface.

The invention can be used in particular for the formation of a temperate cooling zone such as that envisaged in French Patent Application No. 84/15458 filed by the Applicant on Oct. 9, 1984.

The treatment apparatus according to the invention is distinguished by the fact that it has a suction chamber opposite the upper surface of the material and at least at the entry point and at the exit point, a spray bar being arranged between two adjacent suction chambers.

The series of spray bars and suction chambers is organised as follows:

the bars and chambers are separated by free spaced allowing the passage of the air accompanying the sprayer jets. The air throughput is therefore greater than that supplied by the sprayer slots, a feature which is favourable for transportation of the droplets;

the distances between the spray bars and the surface to be cooled, on the one hand, and the distances between two consecutive spray bars, on the other hand, are defined so as to channel the flow of the air emitted by the sprayer and of the secondary air penetrating between chamber and sprayer and accompanying the jet, this channelling making it possible to transport and remove the droplets which bounce off the hot surface.

In particular, the distance between consecutive spray bars is sufficient for there to be substantially no direct interaction between the jets of consecutive sprayers and for it to be possible, moreover, to form and to separate flow zones directed towards the product to be cooled and flow zones departing from the product;

the suction chambers arranged between the spray bars and also at the two ends of the machine are located directly above the zone where the streams of gas and droplets emitted by two consecutive spray bars meet; they have flaps provided on the edges of the suction opening limiting the zone where the streams and droplets are deflected.

The explanations and figures provided below by way of example will make it possible to understand how the invention can be achieved.

Figure 1:
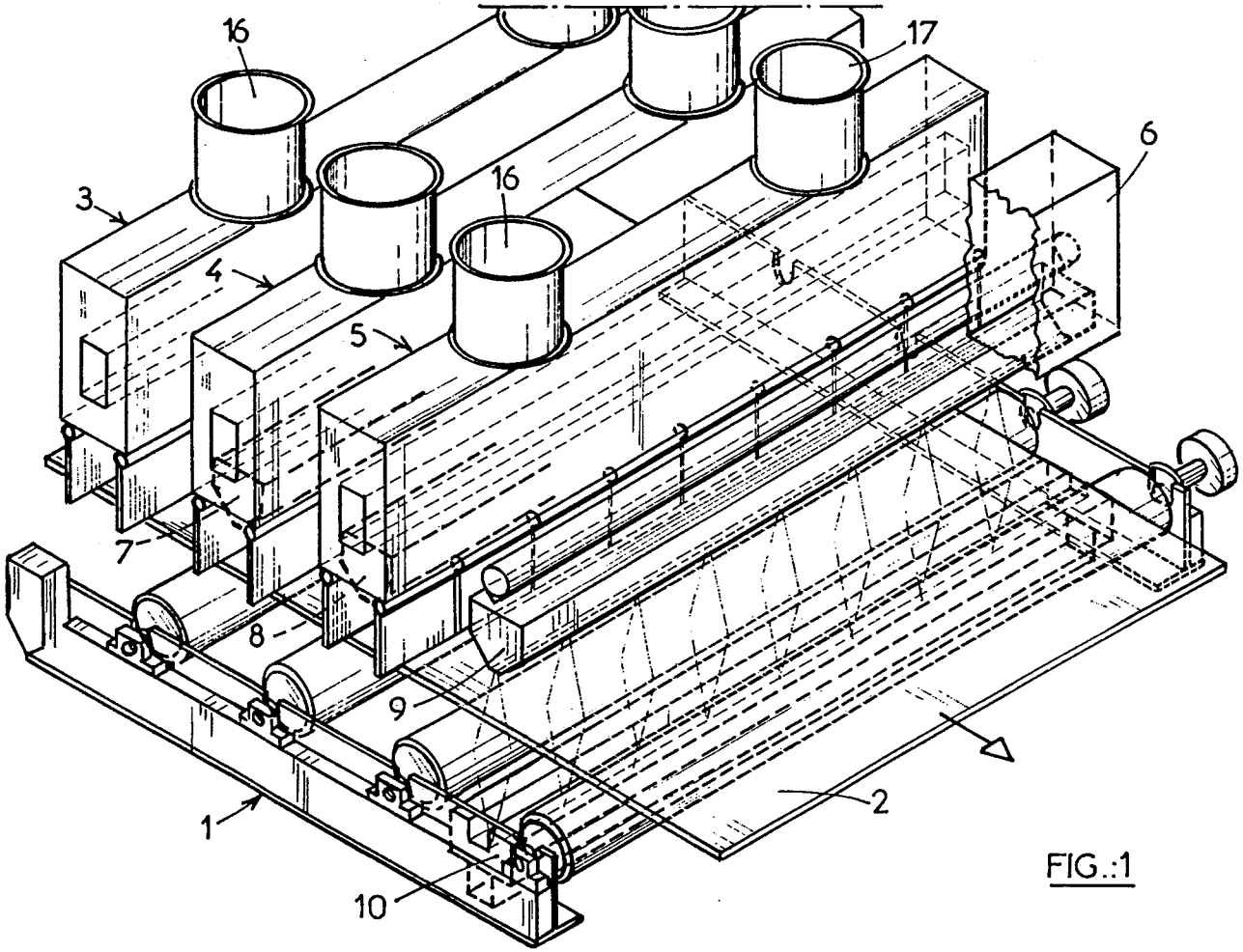
FIG. 1 shows in diagrammatic form a perspective and partially cut-away view of an example of a treatment apparatus according to the invention.

According to the example of embodiment shown in diagrammatic form in FIG. 1, the apparatus according to the invention is intended to cool a horizontally moving metallurgical product after, for example, leaving a treatment furnace or a rolling mill.

A horizontal roller conveyor 1 carries and feeds a metal sheet 2 into a spray-treatment apparatus consisting, according to the example shown, of four suction chambers 3, 4, 5, 6 arranged transversely in relation to the direction of movement of the metal sheet and of three spray bars 7, 8, 9 arranged between the chambers. According to a preferred embodiment, the bars consist of two-dimensional sheet-jet sprayers such as those described, for example, in French Patent No. 2,375,911. The jets of the sprayers reach the metal sheet, spread along its surface and are then deflected upwards when they interact with the streams emitted by the adjacent sprayers. It has been noted, over a fairly large range of throughputs, that the droplets forming the sheets of spray emitted from two adjacent sprayers, after cooling the metal sheet, are deflected, together with the air, into a relatively limited zone located centrally in the space separating the two sprayers. If these deflected droplets are not removed, they grow larger and fall back onto the metal sheet. The water thus deposited in this zone drains off via the edges of the metal sheet where it produces cooling conditions which are different from those initially provided by the sprayed water and achieved in the central zone of the metal sheet.

In order to prevent the droplets growing larger and falling back down, the suction chambers are arranged between the sprayers above the zone where the streams of air and droplets are deflected, the zone being limited by the flaps carried by the openings of the chambers, the free edge of which extends downwards close to the surface of the metal sheet. The distance separating the edge of the flap from the surface of the metal sheet allows the passage of the air flow transporting the droplets which rebound after impact on the metal sheet.

Since the apparatus, according to the example shown, is intended to cool the metal sheets in a homogeneous manner, lower bars 10, the jets of which are directed from the bottom upwards, are arranged beneath the metal sheet and approximately opposite the upper bars 7, 8, 9 such that the surface covered by the jets on the lower surface of the metal sheet corresponds to that covered on the upper surface by the jets of the upper bars. Stresses produced by differences in cooling on the two surfaces of the metal sheet and consequent deformations are thus avoided.

The problem of removing the droplets which have reached the metal sheet does not arise in the case of the lower bars 10, since the droplets fall as a result of gravity and there is no risk of them accumulating on the metal sheet and modifying locally the cooling conditions.

Figure 2:
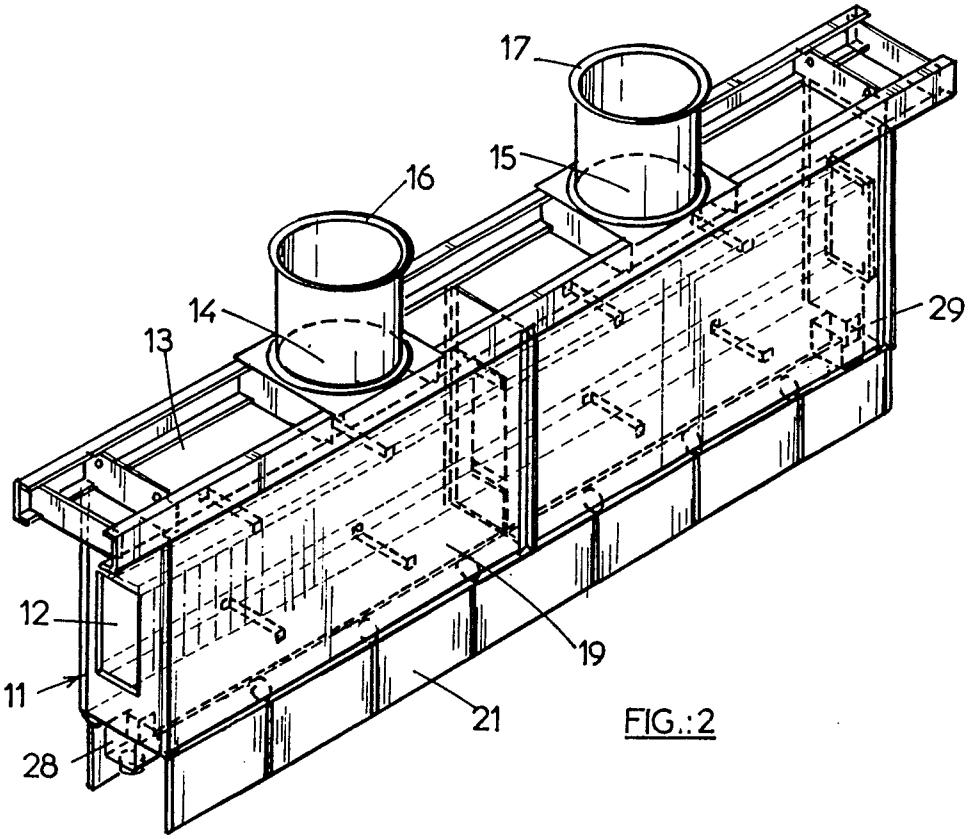
FIG. 2 is a perspective view of a suction chamber.

An embodiment of the suction chambers is shown in FIG. 2. A chamber consists of a metal frame which has approximately the shape of a parallelepiped and is enclosed on three of its longitudinal sides by a casing ensuring leak-tightness. The ends of the chamber are sealed off by plates 11 with a central hatch 12 providing access to the droplet separator. The sections forming the top part of the frame extend outside the casing so that the chamber can be fixed onto the main frame of the apparatus. The upper wall 13 of the casing has, according to the example of embodiment, two circular openings 14, 15 on which cylindrical covers 16, 17 are fixed, the latter being connected to suction fans (not shown).

Figure 3:
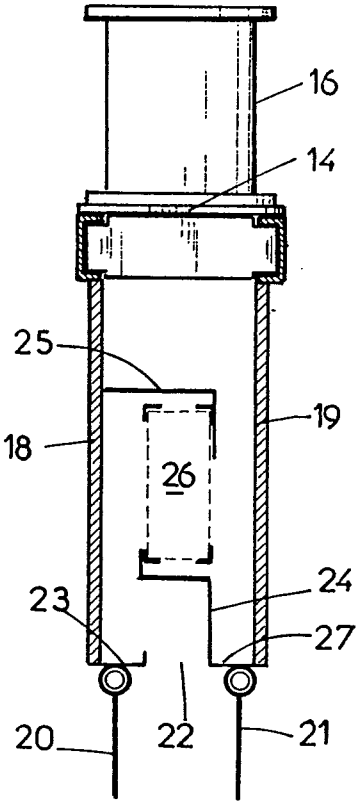
FIG. 3 is a cross-sectional view of the chamber shown in FIG. 2.

According to the cross-section shown in FIG. 3, the chamber has at the bottom, approximately in the extension of its side faces 18, 19, movable flaps 20, 21 which limit and isolate the deflection zone, preventing in the event of deformation of the metal sheet to be treated, damage to the chambers and allowing the deformed metal sheet to pass through. This arrangement allows the upper sprayers to be positioned at a sufficient distance from the operating path (for example 0.7 m) so as to allow the deformed metal sheets to pass without damaging the machine.

The chamber has at the bottom a longitudinal opening 22 which is relatively wide and delimited, on one side, by a gutter 23, and, on the other side, by a separating wall 24 which forms, together with an upper wall 25 and a side of a droplet separator 26, a chamber inside which the air/droplet mixture, which is deflected between the flaps 20, 21, is sucked. Some of the droplets are deposited on the walls and fall into the gutter 23, whereas the remainder passes into the plates of the separator 26 where the droplets are retained and flow off into the bottom part situated between the separating wall 24 and the wall 19 forming a gutter 27. Water chests 28, 29 provided at the ends of the chamber receive the water recovered by the gutters, which is led off via piping (not shown) to a discharge point or to a recycling plant.

The number of components in the apparatus (suction chambers and spray bars) depends on the length of the product to be treated, but also on the cooling capacity required.

Whatever the length of the apparatus and hence the number of elements, the latter will always have one suction chamber at the entry point and one chamber at the exit point so as to prevent as far as possible the spray produced by the spraying bars spreading into the atmosphere.

According to another embodiment, the droplet separators 26 are placed outside the suction chambers. In this case, several suction chambers could be connected to one casing only comprising separators 26 and suction fans.

We claim:

1. Spray-cooling apparatus comprising, in succession, spray bar means and a plurality of suction chambers, said spray bar means being arranged between said suction chambers, said spray bar means and suction chambers each being arranged opposite the surface of a continuously horizontally moving hot sheet of material wherein free spaces are provided between said spray bar means and said chambers for intake of a secondary air flow, the distances between said spray bar means and a hot surface to be cooled and distances between two consecutive spray bar means being selected and defined so as to channel gas flow emitted by a sprayer and the secondary air flow towards the suction chamber and accompanying sprayer jets in such a way as to transport droplets which bounce off the hot surface.

2. Apparatus according to claim 1 wherein the distance between consecutive spray bars is selected and defined in order that the jets of consecutive sprayers form separate flow zones, including a flow zone directed towards the surface to be cooled, a flow zone departing from the said surface, and a zone where the streams of air and droplets emitted by two consecutive sprayers meet.

3. Apparatus according to claim 1 wherein the distance between consecutive spray bar means is sufficiently large for there to be substantially no direct interaction between the jets of consecutive sprayers and for it to be possible to form and to separate flow zones directed towards the product to be cooled and flow zones departing from this product.

4. Apparatus according to claim 1 wherein the suction chambers are arranged above the zone where the streams of air and droplets emitted by two consecutive sprayers meet and have movable flaps provided on the edges of the suction opening limiting the deflection zone of the streams and of the droplets.

5. Apparatus according to claim 1 wherein at least one spray bar means consists of a sheet-jet sprayer.

6. Apparatus according to claim 1 wherein spray bar means are arranged beneath the lower surface of the sheet material, approximately opposite the spray bar means at the upper surface.

7. Apparatus according to claim 1 wherein said suction chambers comprise a parallelepipedic casing closed on three of its longitudinal sides, and wherein said chambers are provided, on the fourth side, with a longitudinal opening, delimited, at least on one side, by a gutter receiving the water formed by the droplets which are deposited on the walls of the casing, water chests are provided at the ends of the chambers, receiving the water recovered by the gutters, and wherein flaps are provided in the extension of the opposed side faces along the opening.

8. Apparatus according to claim 1 wherein the other longitudinal side of said opening is provided with a separating wall comprising a side of a droplet separator which forms, with the sides of the casing opposite with regard to the opening, a chamber inside which the air/-droplet mixture is sucked, the droplets retained by the separator flowing away between the separating wall and the side of the casing, into the water chests provided at the ends of the casing receiving the water recovered by the gutters.

9. Apparatus according to claim 8 wherein the droplet separators are placed outside the suction chambers, several suctions chambers being connected to one casing only comprising separators and suction fans.

* * * * *